United States Patent [19]

Tsuboi

[11] 4,300,465

[45] Nov. 17, 1981

[54] THREAD-TENSION REGULATING DEVICE FOR MULTI-THREAD SEWING MACHINE

[76] Inventor: Shigeo Tsuboi, 26-1, 3-chome, Ohoka-cho, Minami-ku, Yokohama-shi, Japan

[21] Appl. No.: 943,716

[22] Filed: Sep. 19, 1978

[30] Foreign Application Priority Data

Sep. 22, 1977 [JP] Japan ..... 52/127884[U]

[51] Int. Cl.[3] ..... D05B 47/04

[52] U.S. Cl. ..... 112/255; 112/79 A; 112/220; 74/194

[58] Field of Search ..... 112/79 R, 79 A, 255, 112/59, 97, 254, 220; 66/125 R, 146; 242/149, 150; 139/450; 74/194, 190

[56] References Cited

U.S. PATENT DOCUMENTS

| | | | |
|---|---|---|---|
| 485,546 | 11/1892 | Hunt | 112/255 |
| 670,078 | 3/1901 | Humphrey | 112/254 |
| 851,082 | 4/1907 | Fischer | 112/255 X |
| 2,158,197 | 5/1939 | Pikul | 112/255 X |
| 2,191,046 | 2/1940 | Tiesler | 112/255 |
| 2,932,339 | 4/1960 | Odenweller | 112/79 A |
| 3,001,388 | 9/1961 | MacCaffray | 112/79 A X |
| 3,348,582 | 10/1967 | Brookshire | 242/149 |
| 3,356,050 | 12/1967 | Urscheler | 242/150 |
| 3,835,797 | 9/1974 | Franks et al. | 112/79 A |
| 3,906,876 | 9/1975 | Fitton | 112/79 A |

FOREIGN PATENT DOCUMENTS

| | | | |
|---|---|---|---|
| 962568 | 4/1957 | Fed. Rep. of Germany | 112/254 |
| 1061966 | 3/1967 | United Kingdom | 112/79 R |

*Primary Examiner*—Werner H. Schroeder
*Assistant Examiner*—Andrew M. Falik
*Attorney, Agent, or Firm*—Remy J. VanOphem

[57] ABSTRACT

A thread-tension regulating device for multi-thread sewing machines comprises a speed change mechanism and a thread-tension regulating mechanism. The speed change mechanism has an infinite speed variator and pulleys for operating the variator. The thread-tension regulating mechanism comprises a cam shaft rotated by the speed change mechanism, cams fixed onto the cam shaft, operating rods reciprocated by the cams, pairs of tension discs mounted on the corresponding operating rods, and biasing elements for periodically imparting tension to threads which pass between the paired tension discs according to the reciprocating movement of the operating rods. By selecting the shape, dimension and angular phase differences of the cams, a biasing force between the paired tension discs, and the rotational speed of the cam shaft as given by the speed change mechanism, a variety of patterns can be formed on cloth by the multi-thread sewing machine.

11 Claims, 8 Drawing Figures

THREAD-TENSION REGULATING DEVICE FOR MULTI-THREAD SEWING MACHINE

BACKGROUND OF THE INVENTION

This invention relates to a thread-tension regulating device for multi-thread sewing machines and in particular for overlocking type sewing machines.

Conventional multi-thread sewing machines, such as three-thread overlocking type sewing machines, form only a simple overlocked pattern on the marginal portion of cloth. When, for example, three threads of different colors are used, there is formed a pattern comprising two threads A and B running parallel to the edge of cloth and a thread C extending in a zigzag form between the threads A and B as shown in FIG. 6, but the pattern is very simple.

SUMMARY OF THE INVENTION

The object of this invention is to provide a compact thread-tension regulating device which can form an intricate pattern by periodically varying tension given to each sewing thread when it is used with a multi-thread sewing machine.

According to this invention there is provided a thread-tension regulating device for multi-thread sewing machines comprising a plurality of operating rods reciprocable in a longitudinal direction thereof, pairs of tension discs mounted on the respective operating rods, biasing means for elastically urging each pair of the tension discs toward each other and imparting tension varying in accordance with the reciprocating movement of the corresponding operating rod to a thread passing between the paired tension discs and thereafter supplied to a multi-thread sewing machine, actuating means for periodically reciprocating the operating rods, and speed change means for operating said actuating means and varying an operating speed thereof.

DETAILED DESCRIPTION OF THE INVENTION

Figure 1:
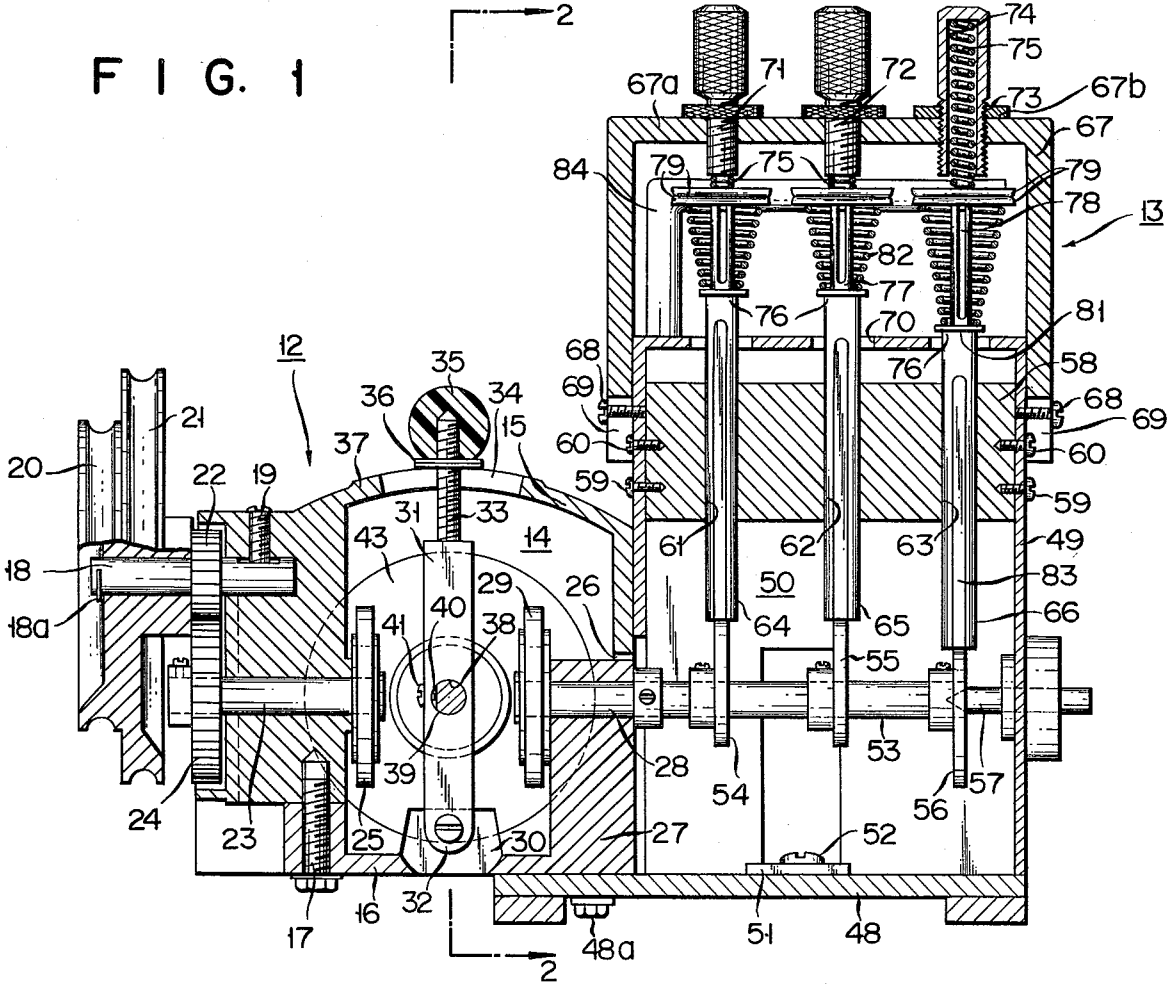
FIG. 1 is a cross-sectional view of a thread-tension regulating device according to an embodiment of this invention.
Figure 2:
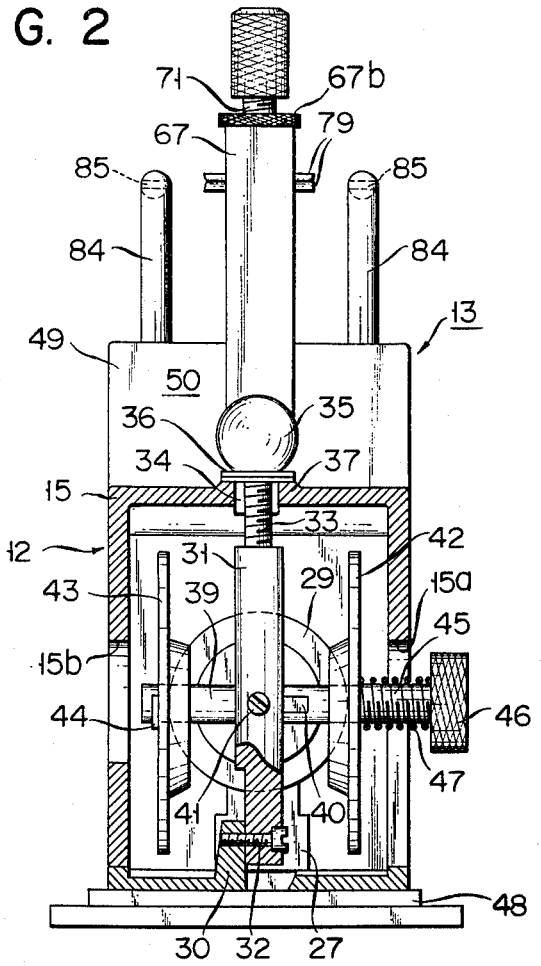
FIG. 2 is a cross-sectional view as taken along line 2—2 of FIG. 1.

Referring to FIGS. 1 and 2, a thread-tension regulating device comprises a speed change mechanism 12 and a thread-tension regulating mechanism 13.

The speed change mechanism 12 includes a housing 14 comprising an upper casing 15 the ceiling of which has a dome-like cross-section, and a base 16 secured by screws 17 to the casing 15.

In FIG. 1, a horizontal shaft 18 is fixed by a pin 19 to the casing 15 and extends from the upper portion of the left side wall of the casing 15. Two pulleys 20, 21 (three or more pulleys may be provided) of different diameters and a gear 22 are mounted on the shaft 18 to permit them to be rotated as a unit. The shaft 18 has a stop 18*a* on the free end thereof to prevent the pulleys 20, 21 and gear 22 from being moved axially of the shaft 18. A rotatable shaft 23 extends in parallel with the fixed shaft 18 through the left side wall of the casing 15. A gear 24 engaging the gear 22 is fixed onto the left end of the shaft 22 and a friction wheel 25 is fixed onto the right end of the shaft 23. On the right end of the base 16 is provided a bearing portion 27 disposed in a cutout 26 formed at the central part of the right side wall of the casing 15. A rotatable shaft 28 coaxially but separately provided passes through the bearing portion 27. Fixed onto the left end of the shaft 28 is a friction wheel 29 having a diameter equal to that of the friction wheel 25. A bearing portion 30 is provided on the substantially central portion of the upper surface of the base 16, and the lower end of an arm 31 is pivotally supported by the bearing portion 30. A screw-threaded rod 33 is fixed to the upper end of the arm 31 such that it extends outward through a slot 34 extending lengthwise of the shafts 23 and 28 in the central portion of the ceiling of the casing 15. A spherical knob 35 made of, for example, a plastic material engages the upper end of the screw-threaded rod 33 such that it can be tightened or loosened. When the knob 35 is tightened, it presses the upper surface of a flange 37 surrounding the slot 34 with washers 36 interposed therebetween to thereby permit the arm 31 to be fixedly placed in a desired position.

A horizontal bore 38 which is perpendicular to the common axis of the shafts 23, 28 is provided at the middle portion of the arm 31 and is located at substantially the same level as that of the shafts 23, 28. A horizontal wheel shaft 39 is inserted into the horizontal bore 38 to be slidable in its longitudinal direction. Formed at the middle portion of the shaft 39 is a flattened portion 40 extending lengthwise of the shaft 39 (FIG. 2). The tip end of a set screw 41 screwed in the arm 31 is positioned so near that it prevents the shaft 39 from being rotated (FIG. 1). On the respective ends of the horizontal shaft 39 are provided friction wheels 42, 43 having a diameter larger than that of the friction wheels 25, 29. The friction wheels 42, 43 can be moved lengthwise of the horizontal shaft 39 with the friction wheels 25, 29 perpendicular thereto sandwiched therebetween. The friction wheels 25, 29, 42, 43 are made of such material to permit them to be rotated without slip by the frictional force between the engaging wheels. For example, the friction wheels 25, 29 are made of plastic material, and the friction wheels 42, 43 are formed on their inner lateral surface with a plurality of alternative fine protuberances and depressions such as in a grid pattern or radial pattern to increase the frictional force.

In FIG. 2, a stop 44 is provided on the left end of the wheel shaft 39 to prevent the friction wheel 43 from slipping off the shaft 39. The other end of the shaft 39 is integrally formed with a screw-threaded portion 45 which extends outward through a hole 15*a* in the right side wall of the casing 15. An adjusting ring 46 threadably engages the free end (the right end) of the screw-threaded portion 45. Between the friction wheel 42 and the adjusting ring 46 is placed a strong compression spring 47 which is wound around the screw-threaded portion 45. The compression spring 47 urges the horizontal shaft 39 and the friction wheel 43 rightward and the friction wheel 42 leftward, with the result that the inner lateral surfaces of the friction wheels 42, 43 are pressed against the peripheral surfaces of the friction wheels 25, 29. When the resilient force of the compression spring 47 is adjusted by tightening or loosening the adjusting ring 46, pressure exerted by the friction wheels 42, 43 on the friction wheels 25, 29 can be adjusted. A hole 15*b* is formed in the left side wall of the casing 15 to give access to the friction wheel 43. It follows that the elements 25 to 47 constitute an infinite speed variator.

The thread tension regulating mechanism 13 includes a housing 50 comprising a base 48 fixed by screws 48*a* (only one is shown in FIG. 1) to the base 16 of the housing 14 and a box-like casing 49 covering the base 48. The casing 49 is fixed by screws 52 (only one is shown in FIG. 1) to the base 48 at its brackets 51 (only one is indicated in FIG. 1) which extend inwardly from the opposed lateral sides of the lower end of the casing 49. That portion of the rotatable shaft 28 which extends into the housing 50 forms a cam shaft 53. A plurality of cams (three cams 54, 55, 56 are shown in FIG. 1) are fixedly mounted at an interval on the cam shaft 53. Generally, the cams 54, 55 and 56 are eccentric circular cams of the same dimension. However, they may have different shapes and/or dimensions corresponding to an overlocked pattern to be formed. The free end (right end) of the cam shaft 53 is supported by a pointed end of a support rod 57 extending through the right side wall of the casing 49 and fixed thereto (FIG. 2).

A guide block 58 is secured by screws 59, 60 to the casing 49 so as to be located above the cam shaft 53 within the casing 49. Vertical guide holes 61, 62, 63 equal in number to the cams are provided in the guide block 58 and arranged right above the corresponding cams such that their axes intersect the axis of the cam shaft 53 at right angles. Operating rods 64, 65, 66 are inserted into the corresponding guide holes 61, 62, 63, respectively.

An inverted U-shaped support frame 67 is disposed such that the center line of the horizontal section 67*a* thereof intersects at right angles with the axes of the respective operating rods 64, 65, 66. The lower ends of both arms of the supporting frame 67 are secured by screws 68 to the casing 49. Downwardly opened slots 69 are provided on the lower ends of the arms of the support frame 67, and the heads of the screws 60 are placed in the slots 69 of the arms of the support frame 67, assuring a positive connection of the support frame 67 to the casing 49.

The upper ends of the operating rods 64, 65, 66 all project upward through large holes 70 in the top wall of the casing 49. Thread-tension adjusting screws 71, 72, 73 (the screw 73 is shown in cross section) are screwed in the horizontal section 67*a* of the supporting frame 67. Within a screw-threaded hole 74 in each of the adjusting screws 71, 72, 73 is housed a compressing spring 75 the lower end of which urges the upper end of the corresponding one of the operating rods 64, 65, 66 elastically downward to permit the lower ends of the operating ends 64, 65, 66 to be pressed against the peripheral surfaces of the corresponding cams 54, 55, 56. A locking nut 67*b* is provided on each of the respective adjusting screws for securing them in position. A shoulder 76 is provided on the intermediate portion of the guide rods 64, 65, 66 which is located above the upper surface of the block 58 in any position of the guide rods 64, 65, 66. The portion of the guide rods 64, 65, 66 which are higher than the shoulders 76 are reduced in their diameter to provide thread restricting section 77 wherein upwardly opened slots 78 are formed. The slot 78 prevents a thread from coming off between tension discs as described below after the threads has passed through the slot 78.

Figure 3:
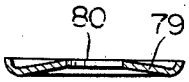
FIG. 3 is a cross-sectional view of a tension disc.
Figure 4:
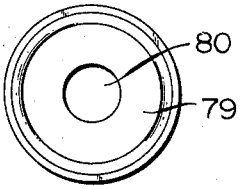
FIG. 4 is a plan view of FIG. 3.
Figure 5:
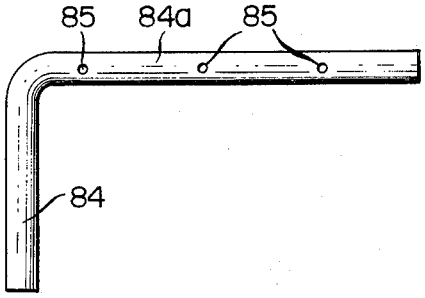
FIG. 5 is a front view of a thread guide bail.
Figure 6:
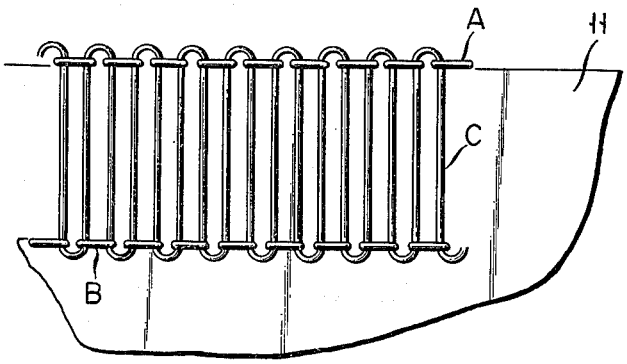
FIG. 6 PRIOR ART
FIG. 6 schematically shows in an enlarged scale an overlocked portion formed on an edge portion of cloth by a conventional overlocking sewing machine.

A pair of tension discs 79 of the same size (each is best shown in FIGS. 3 and 4) are loosely mounted on the respective thread restricting section 77. The compression spring 75 has the inner diameter smaller than the outer diameter of the thread restricting section 77 and the outer diameter larger than the diameter of the central hole 80 of the tension disc 79. Accordingly, the upper tension disc 79 is urged downward. The lower tension disc 79 is urged upward by a conical compression spring 82 which is wound about the thread restricting section 77 and disposed between the lower surface of the lower tension disc 79 and a washer 81 on the shoulder 76 of the respective operating rod. Consequently, a sewing thread is pressed between the paired upper and lower tension discs 79. The pressure on the thread is increased and decreased, respectively, by tightening and loosening the screws 71, 72, 73. The rotation of the operating rods 64, 65, 66 about their axis can be prevented either by providing flattened portions 83 on those portions of the operating rods 74, 75, 76 which pass the holes 61, 62, 63 and the corresponding one of set screws (not shown) screwed in the block 58 and each having a tip end thereof disposed adjacent to the flattened portions 83 or by forming the holes having the cross-section complementary to the cross-section of those portions of the operating rods 64, 65, 66 which include the flattened portions 83.

An L-shaped thread guide bail 84 is fixed to the upper surface of the casing 49 at each side of the support frame 67. The horizontal section 84*a* of the respective thread guide bails 84 is normally located within the areas of the slots 78 of the thread restricting sections 77 of the operating rods 64, 65, 66. Each of the thread guide bails 84 has thread guide holes 85 which align with the slots 78 of thread restricting sections 77 of the operating rods 64, 65, 66.

In operation, a V-belt (not shown) is stretched between the selected one of the pulleys 20, 21 and the corresponding pulley (not shown) of the output shaft of an electric motor (not shown). The smaller the diameter of the pulley 20, 21 is, the faster the speed change mechanism 12 is operated. The rotational force of the pulleys 20, 21 is transmitted through the gears 22, 24 to the friction wheel 25 to rotate the friction wheels 42, 43. The pulleys 20, 21 provide the speed ranges of the mechanism 12. The friction wheels 42, 43 rotate the friction wheel 29 together with the cam shaft 53. In order to rotate the cam shaft 53 at a prescribed speed, the knob 35 is tightened and is fixed to the casing 15. When the arm 31 is swung leftward in FIG. 1 after the knob 35 is loosened, the rotational speed of the cam shaft 53 is decreased. When, on the other hand, the arm 31 is swung rightward, the rotational speed of the cam shaft 53 is increased. The rotational speed of the cam shaft 53 is varied infinitely by the swinging movement of the arm 31. In this way, the desired rotational speed of the cam shaft 53 can be obtained. Once the rotational speed of the cam shaft 53 is selected, the knob 35 is again tightened to hold the arm 31 in position.

In the thread-tension regulating mechanism 13, the cams 54, 55, 56 are fixed to the cam shaft 53 in a manner to be given a predetermined angular phase differences from one after another. The thread tension adjusting screws 71, 72, 73 are set in such a position that a predetermined pressure is imparted to sewing threads placed between the respective pairs of the upper and lower tension discs 79. In other words, a predetermined tension is imparted to the threads between the paired tension discs 79 when the threads are delivered to the multi-thread sewing machine. In FIG. 2, the threads are passed through the corresponding thread guide holes 85 of the left side thread guide bail 84, through the slots 78 between the paired upper and lower tension discs 79, and through the thread guide holes 85 of another thread guide bail 84 in turn. Thereafter, the threads are delivered to the multi-thread sewing machine. As the rotation of the cam shaft 53 continues, the operating rods 64, 65, 66 reciprocate according to the phase differences of the cams 54, 55, 56. As a result, tension acting on the corresponding thread is periodically varied to permit a desired pattern to be formed on cloth by the multi-thread sewing machine.

Figure 7:
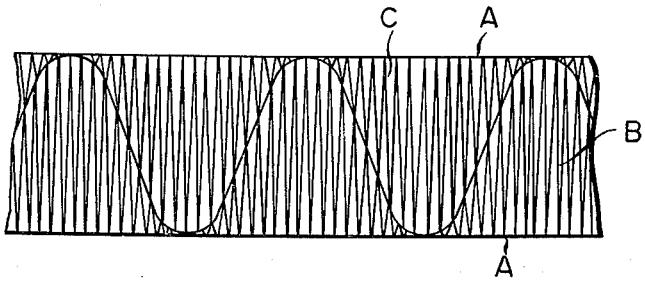
FIG. 7 is a pattern on the overlocked portion formed on an edge portion of cloth by an overlocking sewing machine in use with a thread-tension regulating device according to this invention.
Figure 8:
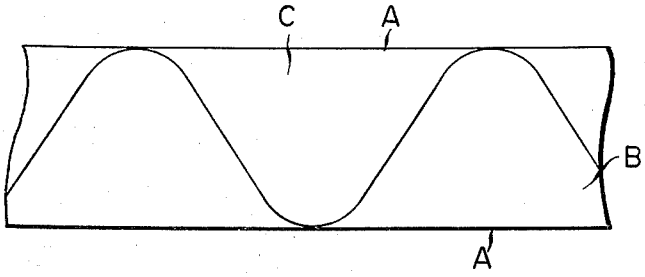
FIG. 8 is another pattern formed on the overlocked portion at a lower cam shaft speed of the device according to this invention than the cam shaft speed employed in forming the pattern in FIG. 7.

Let it be assumed that two cams 54, 55 are arranged in the same angular phase, the cam 56 is displaced in phase from the cams 54, 55 through 180° and the thread-tension adjusting screws 71, 72, 73 are adjusted such that a medium tension is imparted to the thread between the upper and lower tension discs 79. When a needle thread A, upper loop thread B and lower loop thread C are passed between the corresponding tension discs 79 of the operating rods 64, 65, 66, respectively, an overlocked portion having a sine-curved pattern as shown in FIG. 7 is formed on cloth. As shown in FIG. 8, when the rotational speed of a marginal edge portion of the cam shaft 53 is slowed down by the operating of the speed change mechanism 12, a sine-curved pattern on the overlocked portion has a longer wavelength than that of the pattern in FIG. 7. The angular phase differences, shapes and sizes of the cams as well as the cam shaft speed can be selected according to the pattern to be formed.

Various decorative overlocked patterns can be formed on the marginal edge portion of cloth without folding or bending the edge portion of the cloth.

What is claimed is:

1. A thread-tension regulating device of a multi-thread sewing machine comprising:

a plurality of operating rods reciprocable in a longitudinal direction thereof;

pairs of tension discs mounted on the respective operating rods;

biasing means for elastically urging each pair of the tension discs toward each other and imparting tension varying in accordance with the reciprocating movement of the corresponding operating rod to a thread passing between the paired tension discs and thereafter supplied to a multi-thread sewing machine;

a cam shaft extending perpendicularly to said plurality of operating rods;

a plurality of cams fixedly mounted on said cam shaft, each of said cams having a peripheral surface engaging one end of each of said plurality of operating rods respectively; and infinite speed variator means comprising a first friction wheel for rotating said cam shaft, a second friction wheel disposed separately but concentrically with said first friction wheel and having the same diameter as that of the first friction wheel, a wheel shaft disposed perpendicular to the common axis of the first and second friction wheels, third and fourth friction wheels mounted on the respective ends of said wheel shaft and having inner surfaces in contact with the peripheral surfaces of the first and second friction wheels; and moving means for moving said third and fourth friction wheels substantially along the common axis of the first and second friction wheels.

2. The device according to claim 1, wherein said biasing means includes urging elements for pressing the operating rods against the corresponding cams.

3. The device according to claim 2, wherein said operating rods are arranged in parallel with one after another and inserted into a guide block and each of said urging elements comprises a first compression spring disposed between the other end of the respective operating rod and a support frame disposed substantially perpendicular to the operating rods and substantially parallel to the cam shaft.

4. The device according to claim 3, wherein each of said biasing means comprises said first compression spring adapted to urge that tension disc located remote from said one end of the operating rod toward said one end of the operating rod, and second compression spring disposed between an intermediate portion of the operating rod and that tension disc which is near to said one end of the operating rod to urge said near tension disc toward said other end of the operating rod.

5. The device according to claim 4, wherein said supporting frame is provided with thread tension adjusting screws adjusting lengthwise of said operating rods and each having the corresponding one of said first compressed spring housed therein.

6. The device according to claim 5, further providing a slot in each of that portion of said operating rods which lies within an area of the corresponding pair of said tension discs.

7. The device according to claim 1, further including bails having thread guide holes aligned with areas of said paired tension discs.

8. The device according to claim 1, wherein said moving means comprises an arm having said wheel shaft inserted perpendicularly thereinto and swingable about one end thereof along said common axis of said first and second friction wheels, and a setting mechanism for setting the arm in a desired position.

9. The device according to claim 8, wherein said infinite speed variator is disposed within a housing, said one end of said arm is pivoted onto one wall of said housing, and said setting mechanism comprises a screw-threaded rod having one end fixed to the other end of said arm and the other end projecting outward from a slot formed along said common axis of said first and second friction wheels in the opposite wall of said housing to said one wall, and a knob threadably engageable with the other end of said screw-threaded rod to be fixed to the outer surface of said opposite wall when the knob is tightened.

10. The device according to claim 9, wherein the outer surface of said slot in said opposite wall has a circularly arcuate form with a center thereof defined by a point where said arm is pivoted to said one wall of said housing.

11. The device according to claim 1, wherein said wheel shaft is slidable lengthwise through said arm, and the third and fourth friction wheels are slidable lengthwise on said wheel shaft, said wheel shaft being provided on one end with a stop for preventing the adjacent one of the third and fourth friction wheels from slipping off the wheel shaft, and having an adjusting ring engaged with a screw-threaded portion formed on the other end and a compression spring disposed between said adjusting ring and one of said third and fourth friction wheels which is located near the adjusting ring.

* * * * *

UNITED STATES PATENT AND TRADEMARK OFFICE

CERTIFICATE OF CORRECTION

PATENT NO. : 4,300,465

DATED : November 17, 1981

INVENTOR(S) : SHIGEO TSUBOI

It is certified that error appears in the above—identified patent and that said Letters Patent is hereby corrected as shown below:

Column 2, line 14, delete "22" and insert ---23---;

Column 4, line 14, after "section 77" insert ---,---;

Column 5, line 33, delete "sine-curved" and insert ---sine curved---;

Column 5, line 36, delete the word "operating" and insert therefor ---operation---;

Column 5, line 37, delete "sine-curved" and insert ---sine curved---.

Signed and Sealed this

*Nineteenth* Day of *April 1983*

[SEAL]

*Attest:*

GERALD J. MOSSINGHOFF

*Attesting Officer*

*Commissioner of Patents and Trademarks*